US008353328B2

(12) United States Patent
Senk, Jr. et al.

(10) Patent No.: US 8,353,328 B2
(45) Date of Patent: Jan. 15, 2013

(54) SAND-FORMING APPARATUS

(75) Inventors: Gerald B. Senk, Jr., Lagrange, OH (US); Steven J. Sigl, Mentor, OH (US)

(73) Assignee: Equipment Merchants International, Inc., Cleveland, OH (US)

( * ) Notice: Subject to any disclaimer, the term of this patent is extended or adjusted under 35 U.S.C. 154(b) by 0 days.

(21) Appl. No.: 12/602,668

(22) PCT Filed: Jun. 6, 2008

(86) PCT No.: PCT/US2008/066029

§ 371 (c)(1),
(2), (4) Date: Jun. 9, 2010

(87) PCT Pub. No.: WO2008/154335

PCT Pub. Date: Dec. 18, 2008

(65) Prior Publication Data

US 2010/0252221 A1 Oct. 7, 2010

Related U.S. Application Data

(60) Provisional application No. 60/942,810, filed on Jun. 8, 2007, provisional application No. 60/971,928, filed on Sep. 13, 2007, provisional application No. 61/026,570, filed on Feb. 6, 2008.

(51) Int. Cl.

| | |
|---|---|
| ***B22C 9/10*** | (2006.01) |
| ***B22C 9/12*** | (2006.01) |
| ***B22C 15/24*** | (2006.01) |

(52) U.S. Cl. ..... 164/16; 164/21; 164/200

(58) Field of Classification Search ..... 164/12, 164/16, 19–22, 200–202
See application file for complete search history.

(56) References Cited

U.S. PATENT DOCUMENTS

| | | | |
|---|---|---|---|
| 4,836,269 | A | 6/1989 | Bellis et al. |
| 5,038,845 | A | 8/1991 | Kluge |
| 6,866,083 | B2 | 3/2005 | Senk, Jr. et al. |
| 7,137,432 | B2 | 11/2006 | Senk, Jr. et al. |
| 7,284,588 | B2 | 10/2007 | Senk, Jr. et al. |
| 7,441,583 | B2 | 10/2008 | Senk, Jr. et al. |
| 2004/0211537 | A1 | 10/2004 | Senk, Jr. et al. |
| 2006/0032599 | A1 | 2/2006 | Senk, Jr. et al. |

FOREIGN PATENT DOCUMENTS

| | | |
|---|---|---|
| EP | 0815986 | 1/1998 |
| EP | 0844036 | 5/1998 |

OTHER PUBLICATIONS

International Search Report and Written Opinion, Application No. PCT/US2008/066029, mailed Aug. 28, 2008.
International Preliminary Report on Patentability, Application No. PCT/US20081066029, date of issuance Dec. 11, 2009.

*Primary Examiner* — Kuang Lin
(74) *Attorney, Agent, or Firm* — Renner, Otto, Boisselle & Sklar, LLP

(57) ABSTRACT

A sand-forming apparatus (10) comprising a box (20), a blow tube assembly (50) and a bonnet (90). The box (20) has a cope (30) and a drag (40) which together define a cavity (21) having a shape corresponding to a desired sand-shape. The blow tube assembly (50) comprises a blowplate (55), and at least one tube (50). The bonnet (90) may be fixed to and movable with the blowplate (55). Relative movement between the cope (30), the blowplate (55) and/or the bonnet (90) converts the apparatus (10) between a sand-blowing state and a catalyst-introducing state.

71 Claims, 14 Drawing Sheets

SAND-FORMING APPARATUS

RELATED APPLICATIONS

This application relates to U.S. Provisional Patent Application No. 60/942,810 filed on Jun. 8, 2007, U.S. Provisional Patent Application No. 60/971,928 filed on Sep. 13, 2007 and U.S. Provisional Patent Application No. 61/026,570 filed on Feb. 6, 2008. The entire disclosures of these provisional applications are hereby incorporated by reference. If incorporated-by-reference subject matter is inconsistent with subject matter expressly set forth in the written specification and drawings of this disclosure, the latter governs to the extent necessary to eliminate indefiniteness and/or clarity-lacking issues.

TECHNICAL FIELD

The present invention relates generally to a sand forming apparatus that forms a solidified sand-shape (e.g., a core or a mold) for use in the casting of a metal part.

BACKGROUND

When casting a metal part having cavities, openings, surfaces or paths, the foundry industry commonly uses solidified sand-shapes to acquire the desired interior and/or exterior geometry. Specifically, the cast parts are formed by pouring molten metal into and/or around the sand-shapes. Upon completion of casting, the sand-shapes are broken down, shaken-out, de-solidified or otherwise removed from the metal parts. Accordingly, the casting process will begin with the forming of sand-shapes corresponding to the desired geometry of the to-be-cast metal parts.

A sand-shape (e.g., a sand core or a sand mold) is typically formed in a box comprising a cope and drag, which together define a cavity of the desired geometry therebetween. The box is designed for receipt of sand conveyed by pressurized air into the cavity. A catalyst is then introduced into the cavity to solidify the sand contained therein and, after an appropriate curing time, the cavity is purged with air to remove any residual catalyst vapors. Upon completion of the catalyst-introducing and catalyst-purging steps, the box may then be separated, the cured sand-shape and removed, and the process repeated.

SUMMARY

A sand-forming apparatus comprising a box, a blow tube assembly and a bonnet. The box has a cope and a drag which together define a cavity having a shape corresponding to a desired sand-shape. The blow tube assembly comprises a blowplate, and at least one tube. The bonnet may be fixed to and movable with the blowplate. Relative movement between the cope, the blowplate and/or the bonnet converts the apparatus between a sand-blowing state and a catalyst-introducing state. In the sand-blowing state, a sand head can communicate with the cavity via a sand passageway through the blow tube assembly and the bonnet opens to a vent window which communicates with the cavity via cope passages. In the catalyst-introducing state, the sand passageway is sealed from the cavity, and the bonnet defines a sealed catalyst chamber which communicates with the cavity via the cope passages.

DRAWINGS

FIGS. 1, 2, 3, and 4 are sectional views of a sand-forming apparatus and in a sand-blowing state, a sand-tamping state, a catalyst-introducing state, and a cope-ejecting state, respectively.

FIGS. 5, 5A, 5B, and 5C show the sand-forming apparatus in a sand-blowing state in multiple, varied embodiments.

FIGS. 6, 6A, 6B, and 6C show the sand-forming apparatus in a catalyst-introducing state in multiple, varied embodiments.

DETAILED DESCRIPTION

Figure 1:
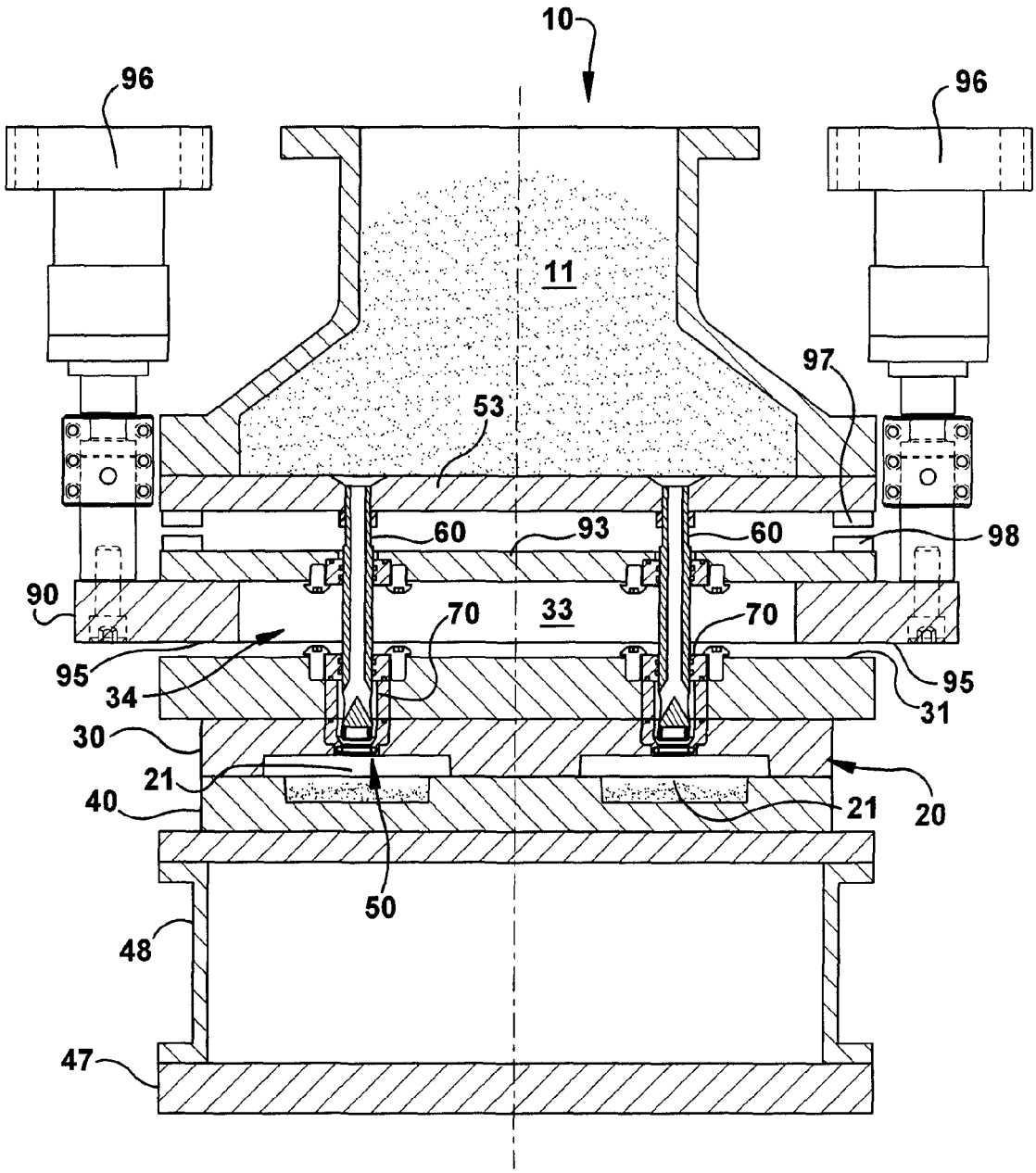
Figure 2:
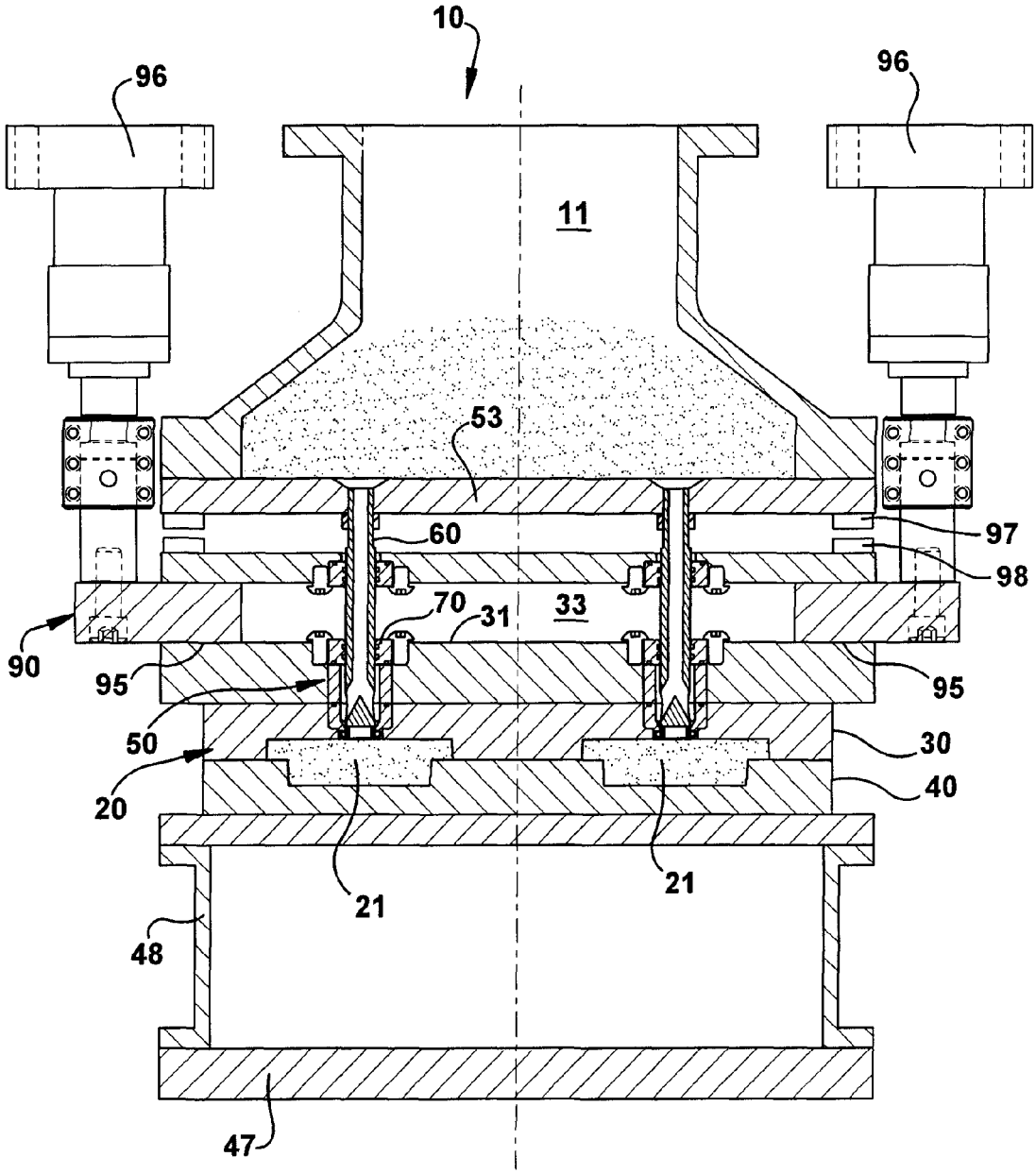
Figure 3:
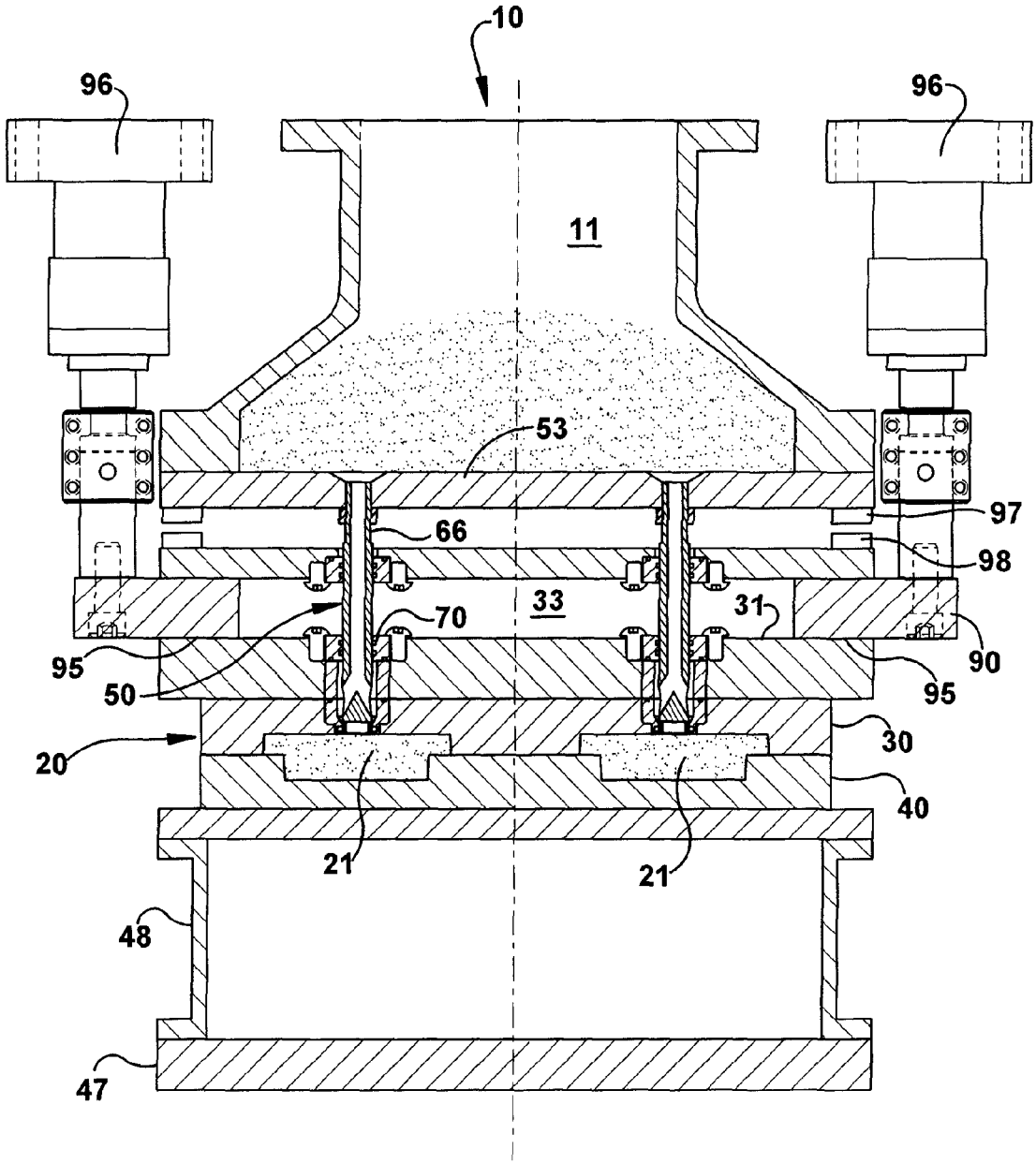
Figure 4:
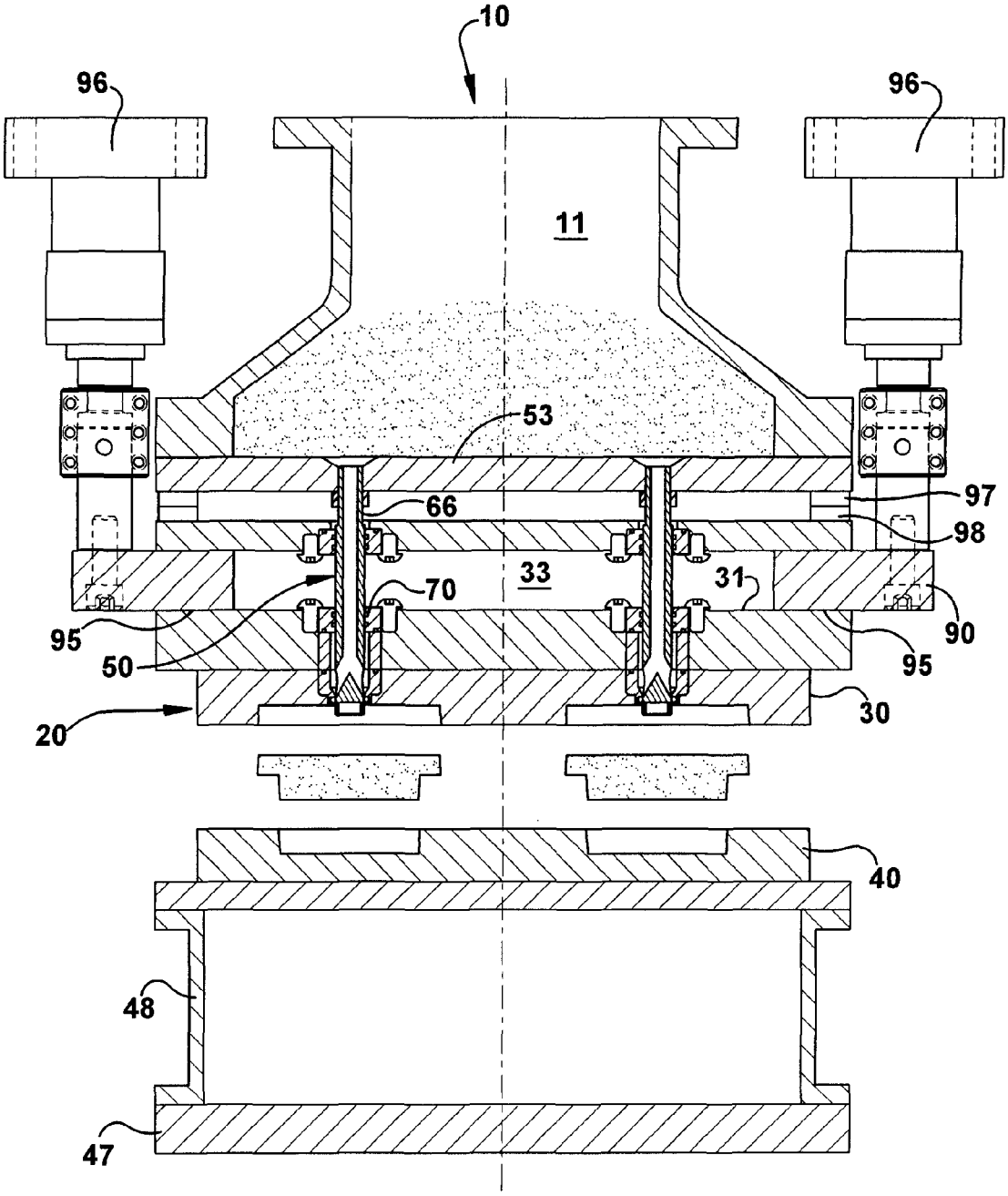
Figure 5:
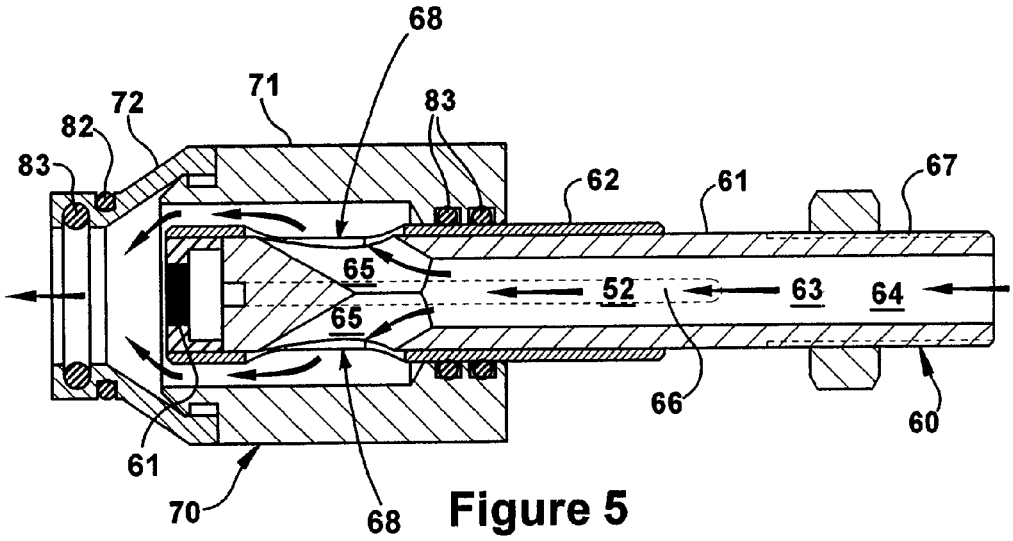
Figure 5A:
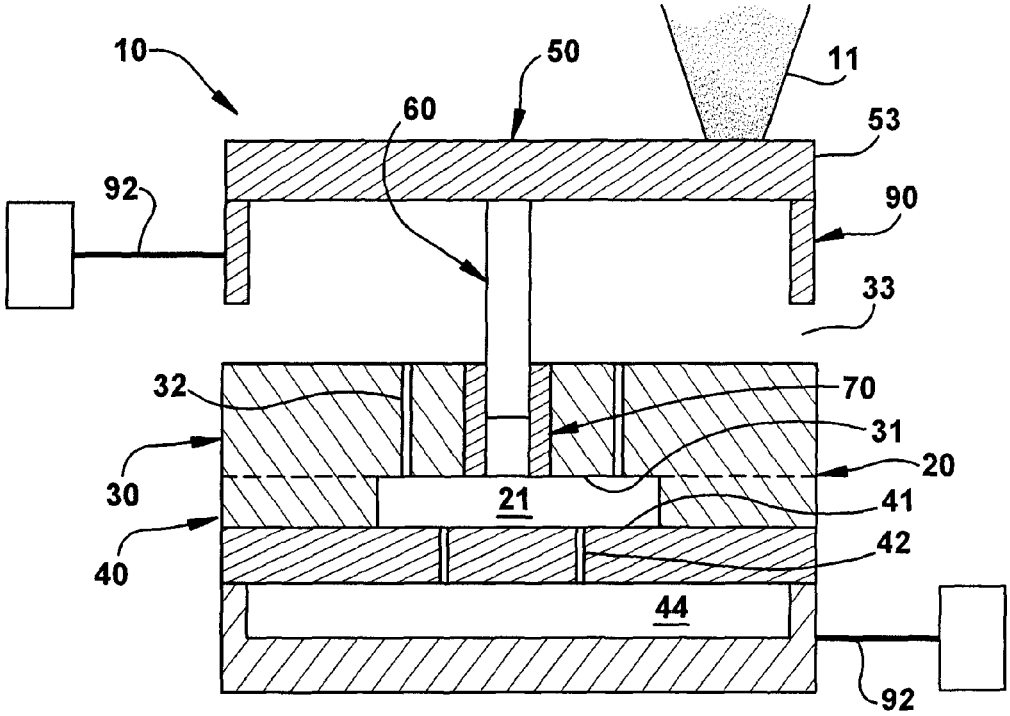
Figure 5B:
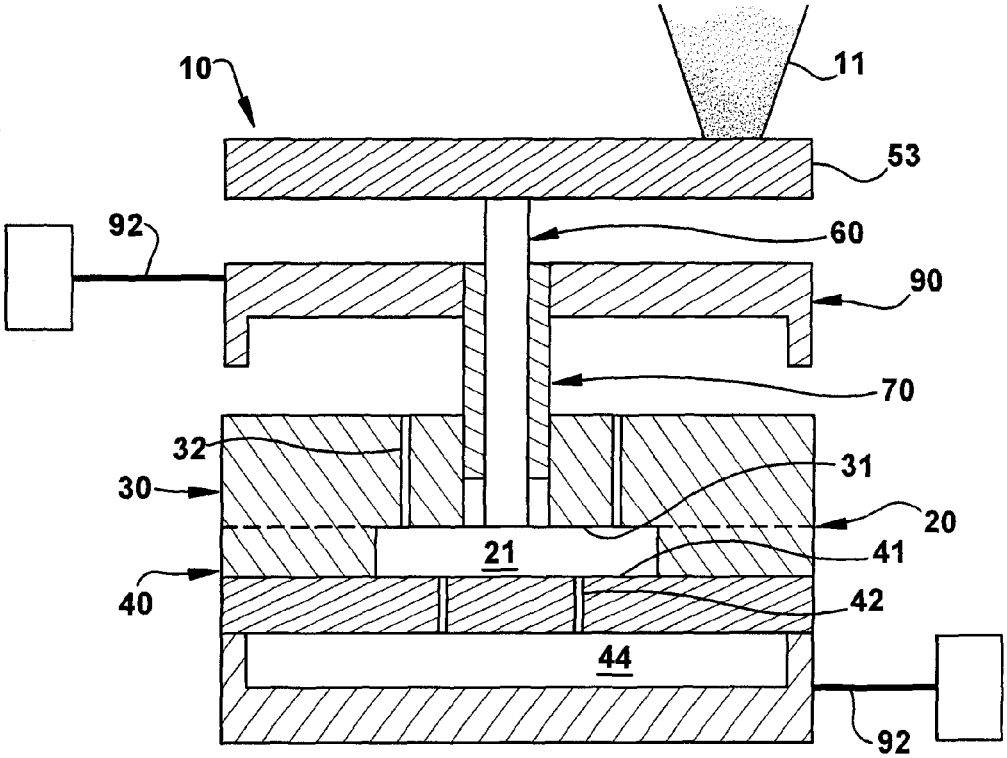
Figure 5C:
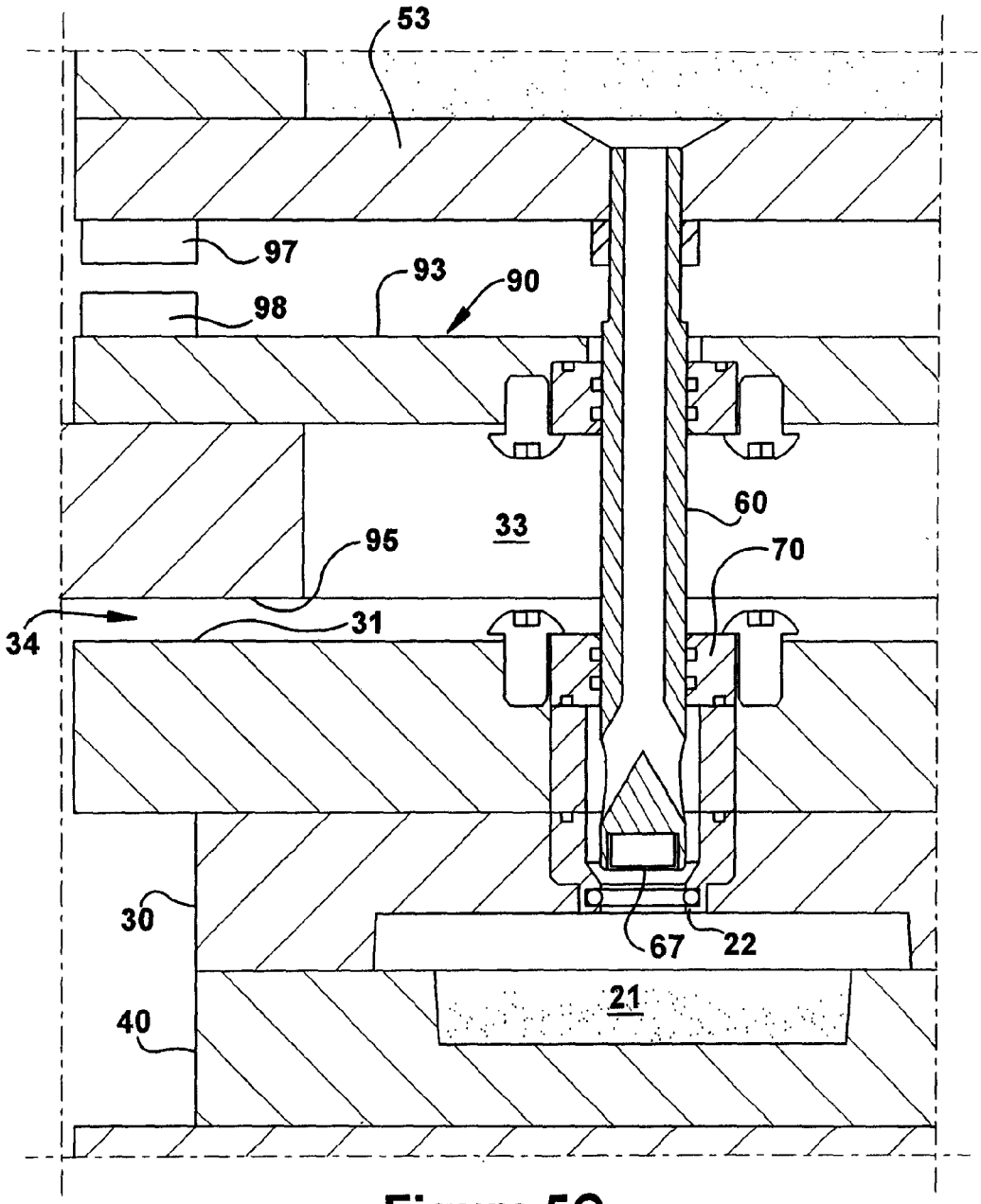

A sand-forming apparatus 10 comprises a box 20 (a cope 30 and a drag 40) defining a cavity 21 having a shape corresponding to a desired sand-shape, and a blow tube assembly 50. The blowtube assembly 50 may include a blowplate 53, a bonnet 90, a first/inner tube 60, and/or a second/outer tube 70. (FIGS. 1, 2, 3, and 4.) Relative movement among the cope 30, the blowplate 53, and/or the bonnet 90 converts the apparatus 10 among a sand-blowing state (FIG. 1), a catalyst-introducing state (FIG. 3), and a cope-ejecting state (FIG. 4). The sand-forming apparatus can also assume a sand-tamping state (FIG. 2). The apparatus 10 is converted between a sand-blowing state (FIGS. 5, 5A, 5B, 5C) and a catalyst-introducing state (FIGS. 6, 6A, 6B, 6C). In the sand-blowing state, a sand head 11 can communicate with the cavity 21 via a sand passageway 51 through the blow tube assembly 50. In the catalyst-introducing state, the sand passageway 51 is sealed from the cavity 21, and the bonnet 90 defines a sealed catalyst chamber 33 which communicates with the cavity 21.

The combination of the blow tube assembly 50 and the bonnet 90 eliminates the need for an extra component (e.g., a gassing manifold) in the sand-forming apparatus 10. Also, the space needed to convert the apparatus 10 from its catalyst-introducing state to its sand-blowing state can literally be an inch or less. It need only be the distance required to separate the bonnet 90 from the cope ceiling 31 to form the vent window 33. The window 33 allows inert gasses to freely vent and escape without the use of valves or other gate structures. Moreover, the window 33 allows access to the cope ceiling 31 whereby it may be periodically wiped, blown or otherwise cleaned of residual sand.

Relative movement between the cope 30 and the blowplate 53 can comprise movement of the cope 30 (e.g., it can consist of movement of the box 20 with or without movement of the blowplate 53). Movement of the cope 30 may be accomplished by lifting of the drag 40 by a lift table 47 with the cope 30 clamped to the drag 40 (FIGS. 1 and 2). The blowtube 50 and the bonnet 90 may not be moved during this conversion. Alternatively, relative movement can comprise movement of the blowplate 53, with or without the cope 30 and/or the box 20 remaining stationary. Cope movement follows the industry trend and thus would probably be adopted in a retrofitting situation. On the other hand, blowplate movement can be less demanding with large and/or heavy boxes, whereby this approach might be preferred.

Figure 6:
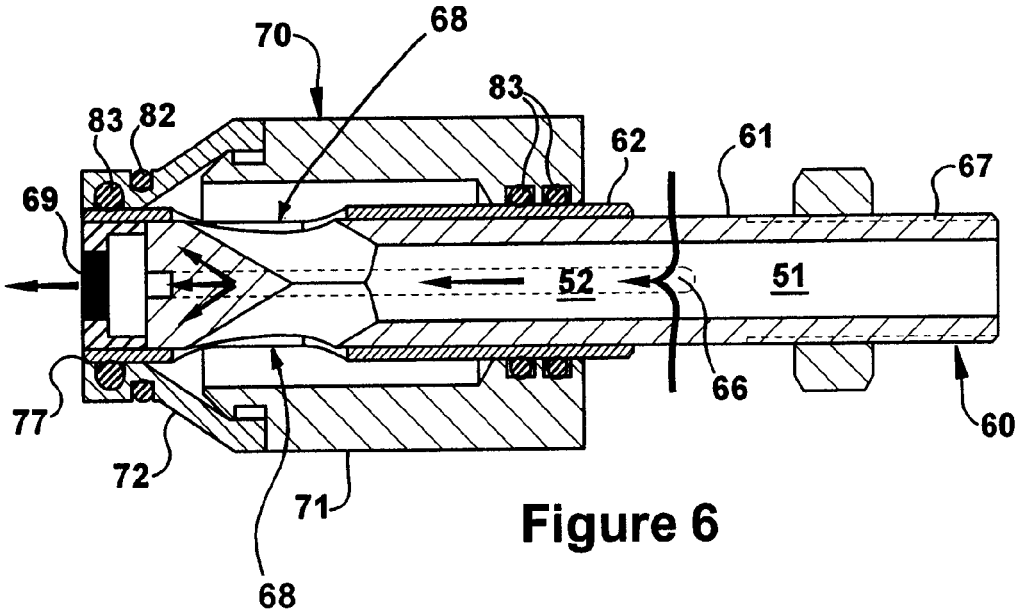
Figure 6A:
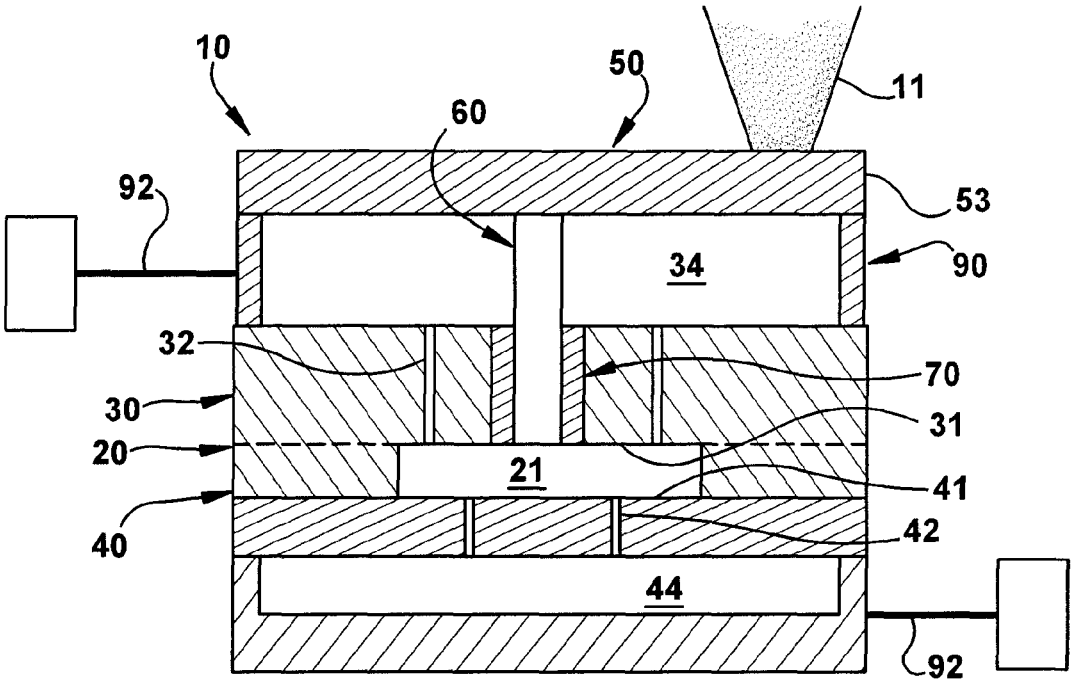
Figure 6B:
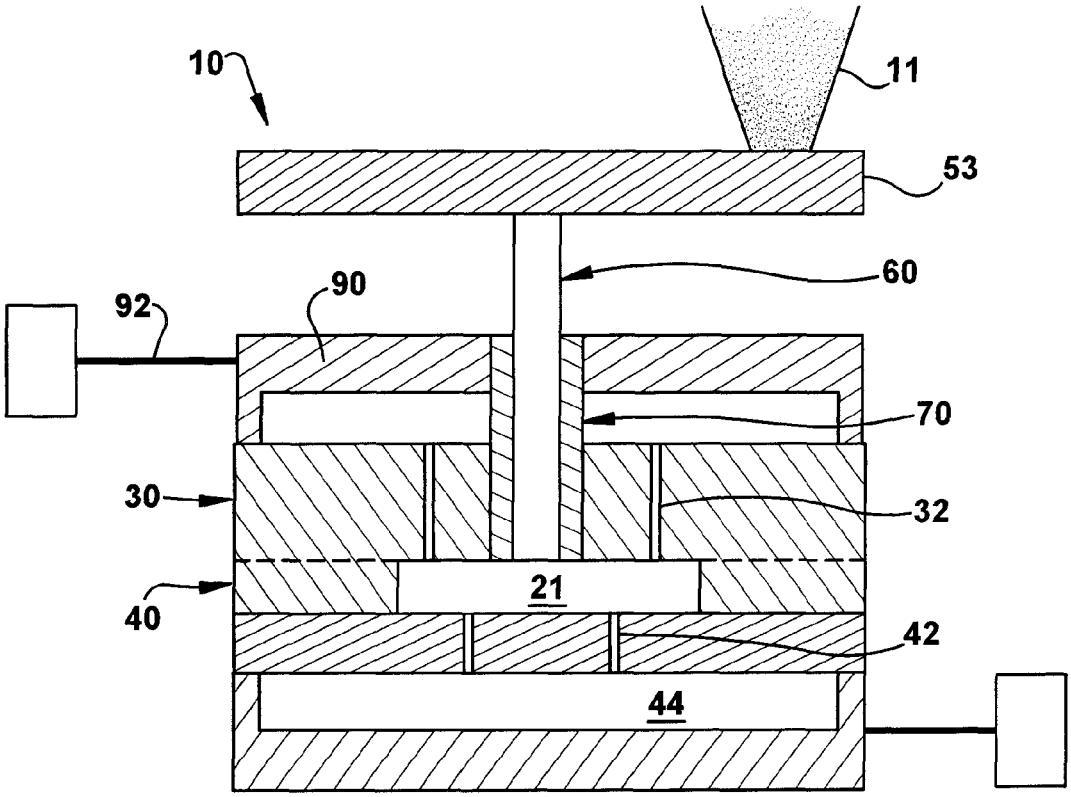
Figure 6C:
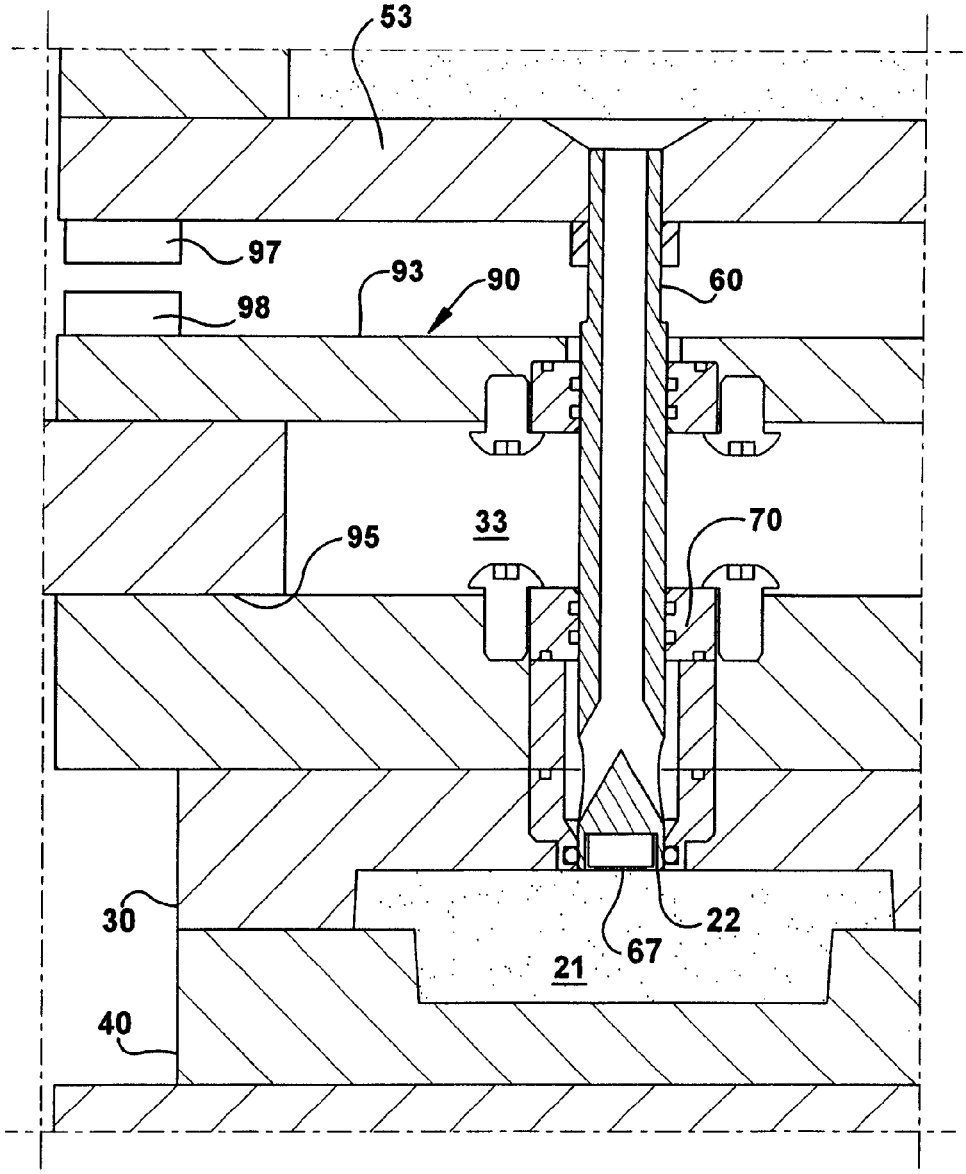

In an alternative embodiment the bonnet 90 may be movable relative to the blowplate 53 where relative movement between the bonnet 90 and the blowplate 53 (and/or the cope 30) converts the apparatus 10 between a sand-blowing state (FIG. 5B) and a catalyst-introducing state (FIG. 6B). In the sand-blowing state, a sand head 11 can communicate with the cavity 21 via a sand passageway through the blowtube assembly 50 and the bonnet 90 opens to a vent window 33 which communicates with the cavity 21 via cope passages 32. The inner tube 60 is fixed relative to the blowplate 53 and the outer tube 70 is mounted for movement with the bonnet 90. These tubes are telescopically moveable relative to each other to convert the assembly 50 between a sand-blowing position and a catalyst-introducing position. In the catalyst-introducing state, the sand passageway is sealed from the cavity 21 , and the bonnet 90 defines a sealed catalyst chamber 34 which communicates with the cavity 21 via the cope passages 32.

The sand-forming apparatus 10 can further comprise a sealed catalyst chamber 44 on the drag side of the box 20, this sealed catalyst chamber 44 communicating with the cavity 21 via drag passages 42. If the cope-side chamber 34 is connected to a catalyst supply line and the drag-side chamber 44 is connected to an exhaust line, catalyst can enter the cavity 21 via the cope passages 32 and exit the cavity 21 via the drag passages 42. If the cope-side chamber 34 is connected to the exhaust line and the drag-side chamber 44 is connected to the supply line, catalyst can enter the cavity 21 via the drag passages 42 and exit the cavity 21 via the cope passages. In either or any case, catalyst fluid (e.g., air, steam, chemically infused gas, etc,) and purge fluid (e.g., air) can enter the cavity 21 via the cope passages 32 and exit the cavity 21 via the drag passages 42, or vice-a-versa. Thus, the apparatus 10 allows for bidirectional catalyst flow and/or purge flow whereby, for example, a "reverse" flow can be used to obtain optimum cure characteristics.

The blow tube assembly 50 comprises a first or inner tube 60 and a second or outer tube 70. These tubes are telescopically moveable relative to each other to convert the assembly 50 between a sand-blowing position (FIG. 5) and a catalyst-introducing position (FIG. 6). In the sand-blowing position, the tubes 60 and 70 form a sand passageway 51 which communicates with the cavity 21. In the catalyst-introducing position, the sand passageway 51 is sealed from the cavity 21. The tubes 60/70 can also provide one or more catalyst passageways 52 when the assembly 50 is in the catalyst-introducing position. However, such passageways 52 will not be necessary in all embodiments of the blow tube assembly, as catalyst introduction through the cope/drag passages 32/42 may be sufficient in some situations.

The inner tube 60 has a cylindrical end region surrounded by the outer tube 70 and/or the inner tube 60 has an annular wall portion 61 and a sleeve portion 62 positioned therearound. If the blow tube assembly 50 does not form catalyst passageways 52, the sleeve portion 62 can be omitted. Also, the catalyst passageways 52 can be formed integrally in the annular wall portion 61 and the sleeve portion 62 can be omitted. In either or any event, one-piece or multi-piece constructions of the inner tube 60 are possible and contemplated.

The annular wall portion 61 has a central passage 63 extending between an axial end opening 64 and radial openings 65. The sleeve portion 62 includes radial openings 68 aligned with the openings 65. If the blow tube assembly 50 is to form catalyst passageways 52 when in its catalyst-introducing position, then the annular wall portion 61 can include grooves 66 in its outer surface. The other axial end 69 of the annular wall portion 61 can be uncovered or covered by a vent, screen, or other filter-like means to enhance distribution. (If the blow tube assembly 50 does not include catalyst passageways 52, this end 69 can be closed.) The sleeve portion 62 partially covers the grooves 66 to form catalyst channels.

The outer tube 70 can comprise a cylindrical stem portion 71 and a tip portion 72, which can be separate components or formed in one piece. If the portions 71/72 are separate components, the tip portion 72 can be made of compressible material (e.g. a rubber material and/or a plastic material) or it can be made of a noncompressible material (e.g., a metal material such as steel or a polymer material such as nylon). This design of the blow tube assembly 50 allows for a shorter outer tube 70 with a height that is, for example, coextensive with the thickness of the cope ceiling.

When the apparatus 10 is in its sand-blowing state and/or when the blow tube assembly 50 is in its sand-blowing position, the sand exits the sand head 11 and, from the top of the blowplate 53, is blown through the sand passageways 51 to enter the cavity 21. Specifically, sand enters the axial opening 64 of the inner tube 60, travels through the central passage 63 and exits into inner tube 60 through the radial openings 65. The outwardly released sand is guided by the outer tube 70 towards the tip portion 72, traveling around the axial end 69 of the inner tube 60 and then being funneled through the flared exit area 77 into the cavity 21. As the sand fills the cavity 21, the air that had previously occupied the space is vented through the cope passages 32 and escapes through the vent window 33 where it is released into the atmosphere. Air can also vent through the drag passages 42.

The cope's ceiling 31 and cope-interfacing surfaces 95 of the bonnet 90 are separated by a non-zero blow-clearance $C_{blow}$, and the outlet end 67 of the first tube 60 is spaced from the inlet 22 of the cavity 21 by this same clearance $C_{blow}$ The bonnet's ceiling 93 and the blowplate 53 are separated by a non-zero eject-clearance $C_{eject}$.

Figure 7:
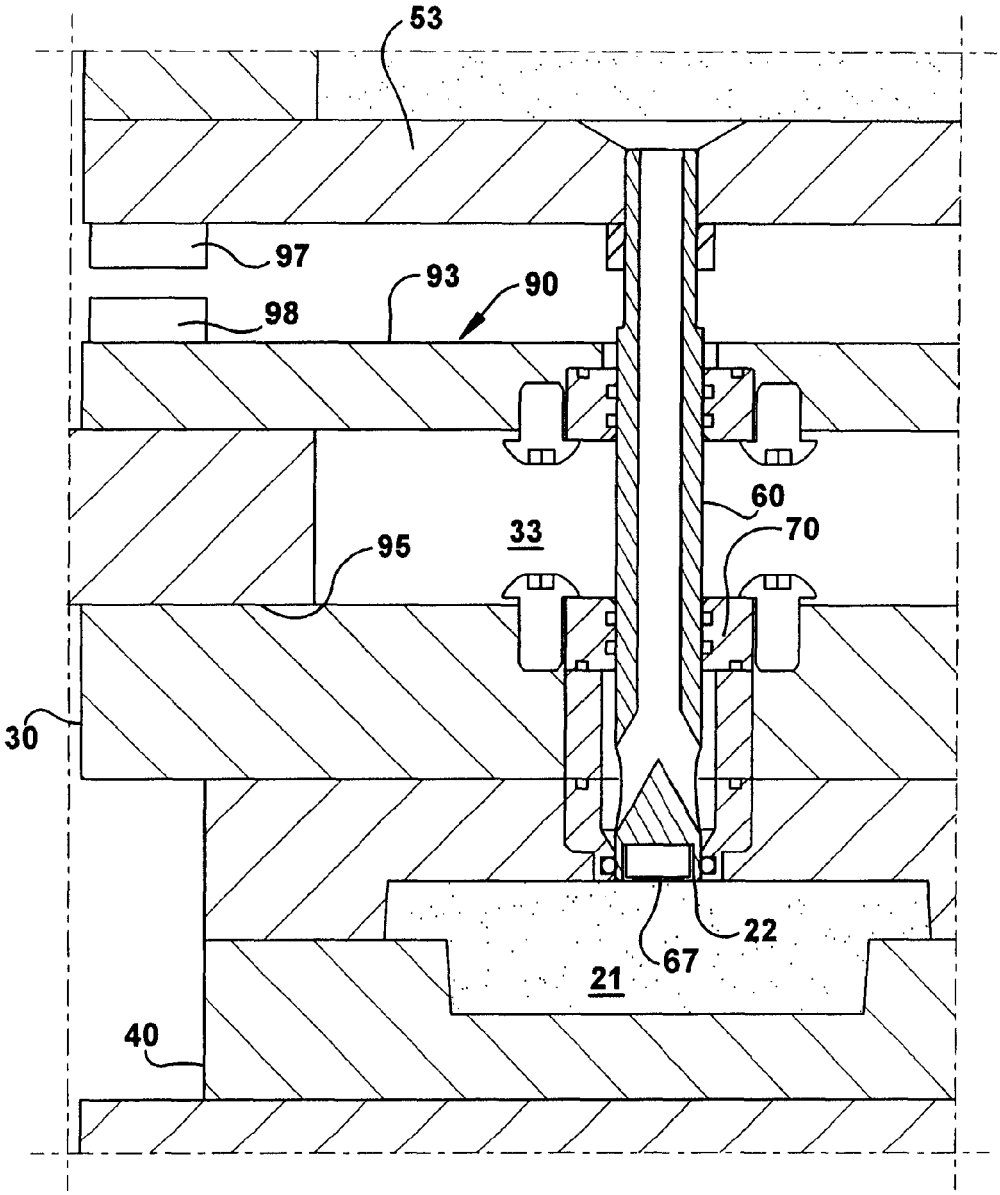
FIG. 7 is a close-up view of the sand-forming apparatus showing the relative position among the cope, the blow tube assembly, and the bonnet, in the sand-tamping state.

In the sand-tamping state (FIG. 7), the relative positions of the cope 30, the blowplate 53 and the bonnet 90 are the same as in the catalyst-introducing state, discussed in the succeeding section. In this state, the first tube 60 tamps sand blown into the cavity 20. In the illustrated embodiment, tamping is accomplished by the conversion of the apparatus 10 from the sand-blowing state to the catalyst-introducing state.

When the apparatus 10 is in its catalyst-introducing state and/or when the blow tube assembly 50 is in its catalyst-introducing position, the catalyst from the cope-side catalyst chamber 34 is introduced into the cavity 21. Specifically, catalyst is introduced through the cope passages 32 and exhausts through the drag passages 42 into the chamber 44 below the drag floor. Alternatively, catalyst is introduced from the chamber 44 through the drag passages 42 and exhausts through the cope passages 32 into the chamber 34.

If the catalyst is introduced through the cope-side chamber 34, and the blow tube assembly 50 is designed to provide catalyst-introducing passageways 52, catalyst from the chamber 34 flows through the grooves 66 between the annular wall 61 of the inner tube 60 and the sleeve 62, and past (but not into) the sand passageways 51. The catalyst then flows through the axial end 69 of the inner tube 60, into the cavity 21 to solidify the sand-shape. The bonnet's ceiling 93 and the blowplate 53 are separated by a eject-clearance $C_{eject}$ when in the catalyst-introducing state. The cope-bonnet clearance $C_{blow}$ closes and the outlet end 67 of the first tube 60 is positioned at the inlet 22 of the cavity 21.

Figure 9:
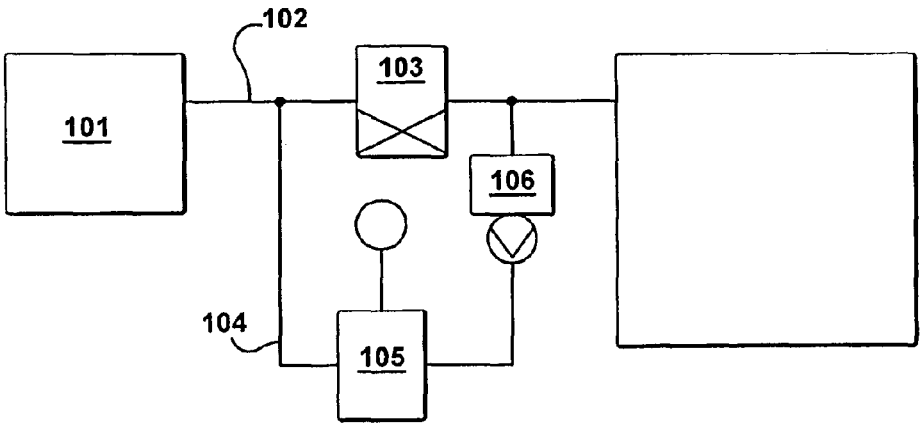
FIG. 9 is a schematic diagram of a sand-passage-sealing system.
Figure 10:
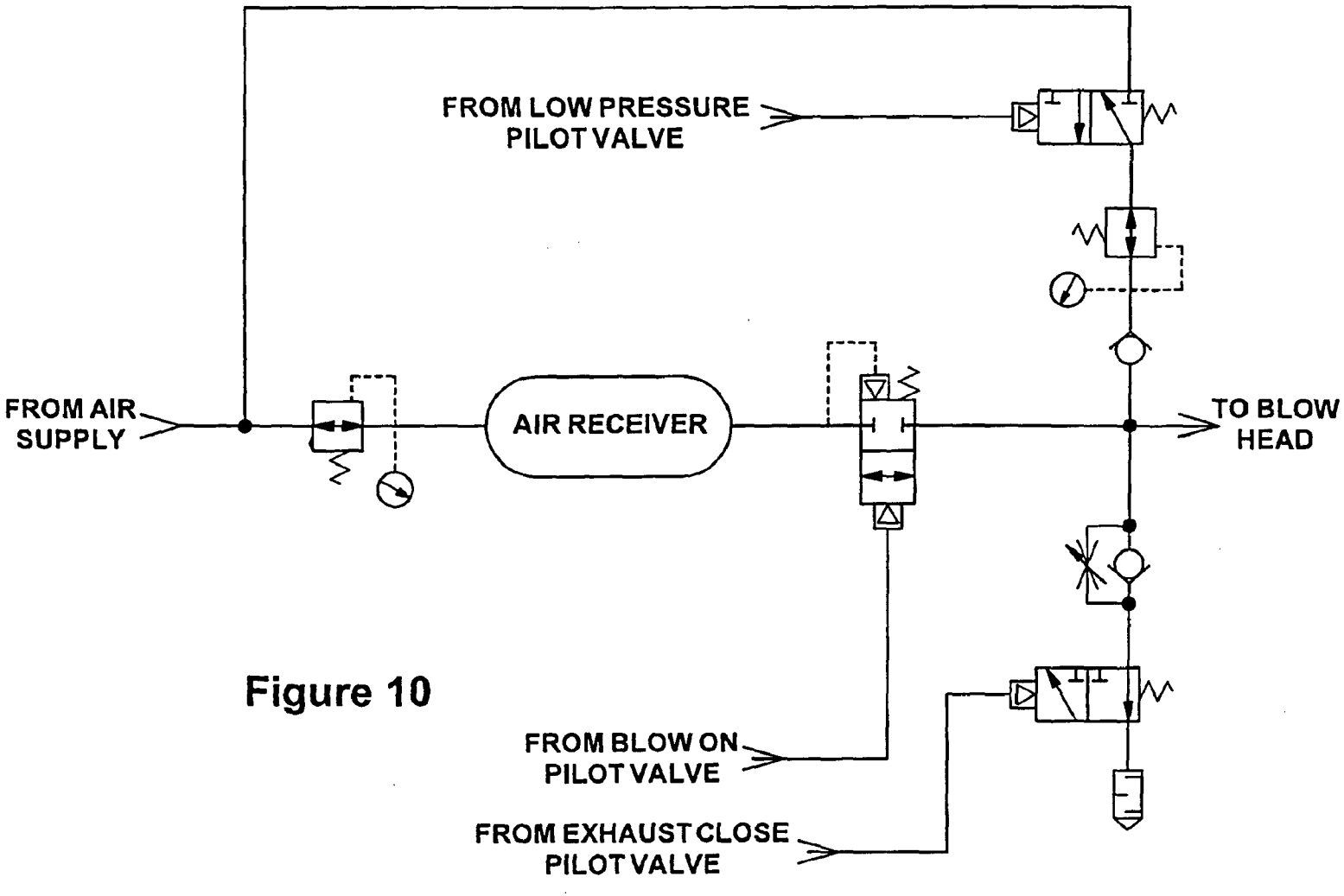
FIG. 10 is a more detailed schematic diagram of a sand-passage sealing system.

A sealing fluid (e.g., air, steam) can be used to provide back pressure on the sand passageway 51 when the apparatus 10 is in its catalyst-introducing state and/or the blow tube assembly 50 is in its catalyst-introducing position (FIGS. 9 and 10). This back pressure can be used as the primary sealing measure or can complement sealing provided by traditional sealing members (e.g., O-rings) which are often susceptible to wear in abrasive sand environments. The sealing fluid can be provided through the same line 102 as the sand-blowing fluid, with a pressure reducing device 105 and a gate device 106 (e.g., a check valve) used to provide an appropriate back pressure.

Conversion from the catalyst-introducing state to the core-ejecting state can be accomplished by movement of the cope 30 and the bonnet 90 towards the blowplate 53. The cope 30 can be clamped to the bonnet 90 so that it moves therewith, and the bonnet 90 can be moved by cylinder-piston assemblies 96. The blowplate 53 can remain stationary during this movement. Stops 97 and 98 can be used to limit movement of the bonnet 90.

Figure 8:
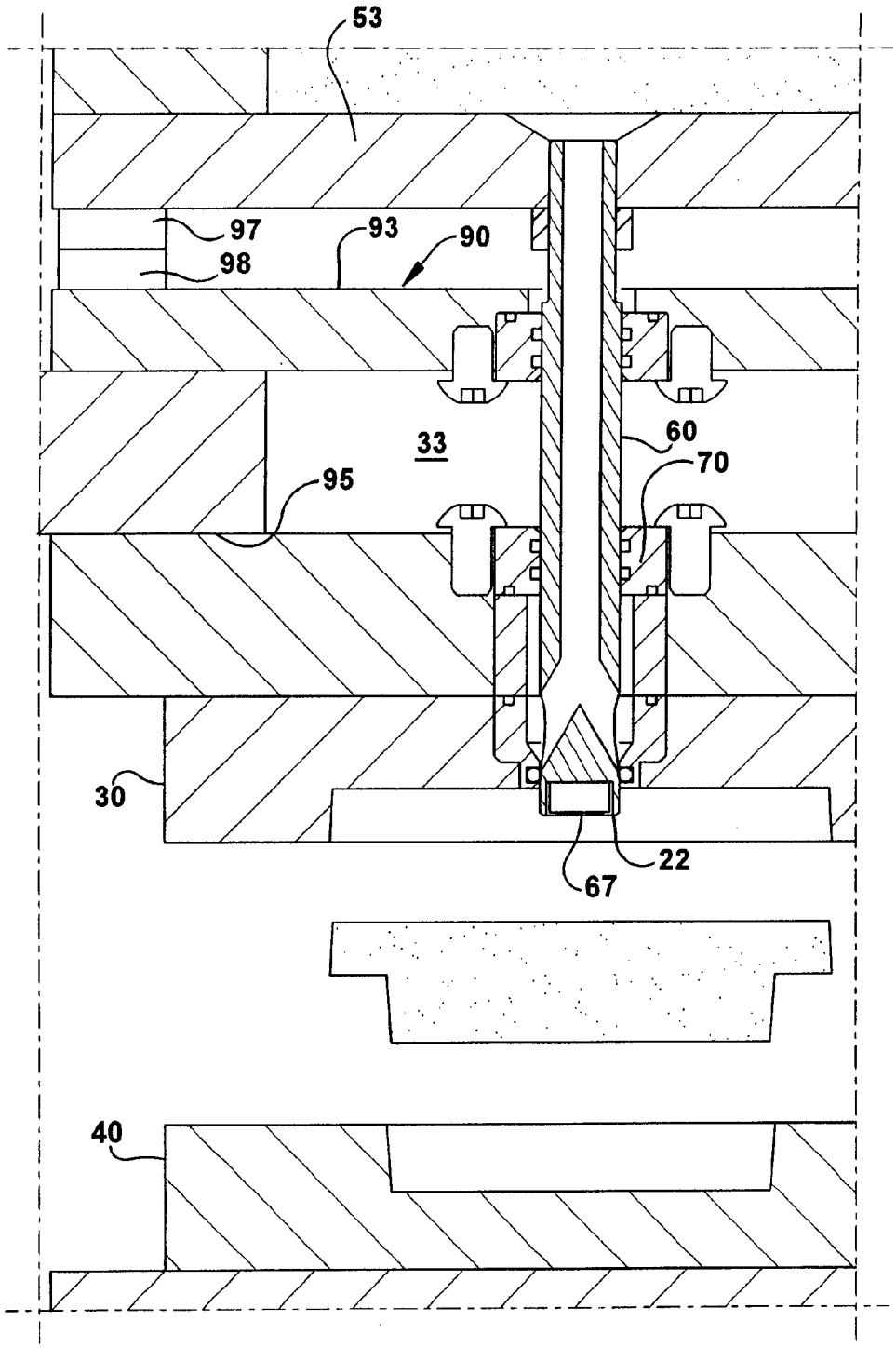
FIG. 8 is a close-up view of the sand-forming apparatus showing a relative position among the cope, the blow tube assembly, and the bonnet, in the cope-ejecting state.

In the cope-ejecting state (FIG. 8), the sand passageway remains sealed from the cavity 21, the bonnet 90 continues to define a sealed chamber 33, and the cope-bonnet clearance $C_{blow}$ remains closed. The bonnet-blowplate clearance $C_{eject}$ closes and the outlet end 67 of the first tube 60 extends into the cavity 21 by a distance $C_{eject}$ in the core-ejecting state.

The sand-forming apparatus 10 can be constructed to be compatible with conventional box tooling whereby an existing sand-forming apparatus to be converted into the sand-forming apparatus 10 without having to completely replace a company's current tooling. Specifically, this conversion could be accomplished by removing the existing manifold, substituting the blow tube assembly 50, and securing the bonnet 90 to the blowplate 53.

The invention claimed is:

1. A sand-forming apparatus comprising:

a box comprising a cope and a drag which together define a cavity-having a shape corresponding to a desired sand-shape;

a blowtube assembly comprising a blowplate and a first tube mounted thereon, the blowtube assembly positioned to enable communication with the cavity;

a bonnet integral with or adjacent to the blowplate; and a sealed catalyst chamber on a drag side of the box, wherein the sealed catalyst chamber communicates with a source of catalyst, wherein relative movement among the cope, the blowplate, and/or the bonnet, converts the apparatus among:

a sand-blowing state whereat a sand head can communicate with the cavity via a sand passageway through the blowtube assembly; and a catalyst-introducing state whereat the sand passageway is sealed from the cavity.

2. A sand-forming apparatus as set forth in claim 1, wherein the bonnet defines a chamber that opens to a vent window which communicates with the cavity via cope passages and wherein the bonnet defines the sealed catalyst chamber which communicates with the cavity to solidify the sand blown thereinto to form the desired sandshape.

3. A sand-forming apparatus as set forth in claim 1, wherein conversion from the sand-blowing state to the catalyst introducing state comprises movement of the cope relative to the bonnet.

4. A sand-forming apparatus as set forth in claim 3 wherein movement of the cope consists of movement of the box.

5. A sand-forming apparatus as set forth in claim 1, wherein the relative conversion movement between the cope and the blowplate comprises nonmovement of the blowplate.

6. A sand-forming apparatus as set forth in claim 1, wherein the relative conversion movement between the cope and the blowplate comprises movement of the blowplate.

7. A sand-forming apparatus as set forth in claim 1, wherein the relative conversion movement between the cope and the blowplate comprise nonmovement of the cope and/or box.

8. A sand-forming apparatus as set forth in claim 1, wherein the bonnet is fixed to and movable with the blowplate.

9. A sand-forming apparatus as set forth in claim 1, the sealed catalyst chamber communicating with the cavity via drag passages.

10. A sand-forming apparatus as set forth in claim 9, wherein the sealed catalyst chamber on the cope side of the box is connected to a catalyst supply and the sealed catalyst chamber on the drag side of the box is connected to a catalyst exhaust, whereby catalyst enters the cavity via the cope passages and exits the cavity via the drag passages.

11. A sand-forming apparatus as set forth in claim 1, wherein, when the apparatus is in the catalyst-introducing state, the sealed catalyst chamber on the cope side of the box communicates with the cavity via a catalyst passageway through the blow tube assembly.

12. A sand-forming apparatus as set forth in claim 11, wherein the sand passageway is sealed from the catalyst passageway when the apparatus is in its catalyst-introducing state.

13. A sand-forming apparatus as set forth in claim 1, wherein the blowtube assembly comprises a second tube.

14. A sand-forming apparatus as set forth in claim 13, wherein the first tube is an inner tube and a second tube is an outer tube at least partially surrounding the first tube.

15. A sand-forming apparatus as set forth in claim 13, wherein the relative movement to convert among the sand-blowing state, the catalyst-introducing state, and the cope-ejecting state comprises relative movement between the first tube and the second tube.

16. A sand-forming apparatus as set forth in claim 15 wherein, when the apparatus is in its cope ejecting state, the blowtube assembly pushes the sandshape from the cavity.

17. A sand-forming apparatus as set forth in claim 15, wherein conversion to the cope-ejecting state comprises movement of the cope relative to the blowplate.

18. A sand-forming apparatus as set forth in claim 1, wherein relative movement of the cope, the blowplate, and/or the bonnet, converts the apparatus from the sand-blowing state to a sand-tamping state whereat the blowtube assembly tamps sand blown into the cavity during the sand-blowing state.

19. A sand-forming apparatus as set forth in claim 18, wherein the relative positions of the cope, the blowplate and the bonnet are the same in the sand-tamping state and the catalyst-introducing state.

20. A sand-forming apparatus as set forth in claim 18, wherein, in the sand-tamping state, the first tube tamps sand blown into the cavity.

21. A sand-forming apparatus as set forth in claim 1, wherein the first tube is connected to the blowplate for movement or nonmovement therewith.

22. A sand-forming apparatus as set forth in claim 1, wherein the relative movement to convert among the sand-blowing state, the catalyst-introducing state, and the cope-ejecting state comprises nonmovement of the first tube.

23. A sand-forming apparatus as set forth in claim 1, wherein the first tube extends through the chamber formed by the bonnet.

24. A sand-forming apparatus as set forth in claim 13, wherein the second tube is mounted to the cope for movement or nonmovement therewith.

25. A sand-forming apparatus as set forth in claim 1, further comprising eject-conversion-motivating means for converting to the cope-ejecting state.

26. A sand-forming apparatus as set forth in claim 25, wherein the eject-converting means moves the bonnet relative to the cope.

27. A sand-forming apparatus as set forth in claim 25, wherein the eject-converting means moves the first tube relative to a/the second tube.

28. A sand-forming apparatus as set forth in claim 25, wherein the eject-converting means moves the first tube relative to the cope.

29. A sand-forming apparatus as set forth in claim 1, wherein the cope and the drag are not movable relative to each other in the sand-blowing state and the catalyst-introducing state.

30. A sand-forming apparatus as set forth in claim 1, wherein the cope and the drag are lifted to convert to the sand-blowing state.

31. A sand-forming apparatus as set forth in claim 1, wherein the cope and the drag are lowered to convert from the sand-blowing state to the catalyst-introducing state.

32. A sand-forming apparatus as set forth in claim 1, wherein the cope is movable relative to the drag in the cope-ejecting state, whereby the drag can be lifted/lowered relative to the cope.

33. A sand-forming apparatus as set forth in claim 1, further comprising box-lift-lower means for moving the cope and/or the drag.

34. A sand-forming apparatus as set forth in claim 33, wherein the box-lift-lower means moves the cope and the drag when converting between the sand-blowing state and the catalyst-introducing state.

35. A sand-forming apparatus as set forth in claim 33, wherein the box-lift-lower means moves the cope relative to the drag when converting to the cope-ejecting state.

36. A sand-forming apparatus as set forth in claim 1, wherein the box-lift-lower means comprises a lift table.

37. A sand-forming apparatus as set forth in claim 1, wherein the drag is mounted on a stool on the lift table.

38. A sand-forming apparatus as set forth in claim 1, comprising a catalyst-supply inlet is connected to a catalyst supply source and a catalyst-exhaust outlet is connected to a catalyst exhaust, in the catalyst-introducing state.

39. A sand-forming apparatus as set forth in claim 1, wherein the blowtube assembly comprises a plurality of first tubes and a corresponding plurality of second tubes.

40. A method of making a sand-shape with the sand-forming apparatus as set forth in claim 1, said method comprising the steps of:

blowing sand into the cavity when the apparatus is in its sand-blowing state;

moving one or more of the cope, the blowplate and the bonnet to convert from the sand-blowing state to the catalyst-introducing state;

introducing catalyst into the cavity when the apparatus is in its catalyst-introducing state; and ejecting the sandshape from the cope when the apparatus is in its cope-ejecting state.

41. A method as set forth in claim 40, further comprising the step of converting the apparatus from its sand-blowing state to its catalyst-introducing state after said sand-blowing step and prior to a subsequent catalyst-introducing step.

42. A method as set forth in claim 40, further comprising the step of tamping the sand in the cavity after a sand blowing step and prior to a subsequent catalyst introducing step, wherein said tamping step is performed when converting the apparatus from its sand-blowing state to its catalyst-introducing state.

43. A method as set forth in claim 40, further comprising the step of converting the apparatus from its cope-ejecting state to its sand-blowing state after said cope-ejecting step and prior to a subsequent sand-blowing step.

44. A method as set forth in claim 40, further comprising the step of periodically cleaning the cope ceiling when the apparatus is in its sand-blowing state.

45. A method as set forth in claim 44, wherein the cope ceiling is accessible through the vent window which communicates with the cavity via cope passages.

46. A method as set forth in claim 40, wherein said catalyst introducing step comprises admitting catalyst to the cavity through cope passages in the cope and exhausting catalyst from the cavity through drag passages in the drag.

47. A method as set forth in claim 40, wherein said catalyst introducing step comprises admitting catalyst to the cavity through drag passages in the drag and exhausting catalyst from the cavity through cope passages in the cope.

48. A method of making a cast metal part, said method comprising the steps of:

forming a sand-shape by the method set forth in claim 40;

pouring molten metal into and/or around the sand-shape;

hardening the poured molten metal; and removing the sand-shape from the metal part.

49. A method as set forth in claim 48, wherein said removing step comprises breaking down the sand-shape.

50. A method as set forth in claim 48, wherein said removing step comprises desolidifying the sand-shape.

51. A method as set forth in claim 50, wherein said desolidifying step is accomplished with a fluid.

52. A method as set forth in claim 51, wherein the fluid is a liquid.

53. A method as set forth in claim 52, wherein the liquid comprises water.

54. A method as set forth in claim 53, wherein the liquid is sprayed.

55. A sand-forming apparatus, comprising a bonnet fixed to and movable with a blowplate;

a box comprising a cope and a drag which together define a cavity having a shape corresponding to a desired sand-shape;

wherein relative movement between the cope and the blowplate converts the apparatus between:

a sand-blowing state whereat a sand head can communicate with the cavity via a sand passageway through a blow tube assembly, the bonnet opens to a vent window on a cope side of a box, and the vent window communicates with the cavity via cope passages; and a catalyst-introducing state whereat a sand passageway is sealed from the cavity, the bonnet defines a sealed catalyst chamber on the cope side of the box, and the sealed catalyst chamber communicates with the cavity via the cope passages, and wherein the apparatus further comprises a sealed catalyst chamber on a drag side of the box, wherein the sealed catalyst chamber on the drag side of the box communicates with a source of catalyst.

56. A sand-forming apparatus as set forth in claim 55, wherein a sealing fluid is passed through the sand passageway of the blow tube assembly when the blow tube assembly is in its catalyst-introducing position to seal, or facilitate sealing, of the sand passageway from the cavity.

57. A sand-forming apparatus as set forth in claim 55, wherein the sand-passage-sealing fluid comprises a pressure-holding gas.

58. A sand-forming apparatus as set forth in claim 57, wherein the sand-passage-sealing fluid comprises air.

59. A sand-forming apparatus as set forth in claim 57, wherein the sand-passage-sealing fluid comprises steam.

60. A sand-forming apparatus as set forth in claim 56, wherein the sand-passage-sealing fluid is provided at a sand-passage-sealing pressure greater than a catalyst-introducing pressure.

61. A sand-forming apparatus as set forth in claim 60, further comprising a sand-blowing-fluid line which supplies a sand-blowing-fluid to the sand passageway to convey sand therethrough when the apparatus is in its sand-blowing state.

62. A sand-forming apparatus as set forth in claim 61, wherein the sand-blowing-fluid is a gas.

63. A sand-forming apparatus as set forth in claim 62, wherein the sand-blowing-fluid is air.

64. A sand-forming apparatus as set forth in claim 61, wherein the sand-blowing-fluid line includes a valve which is open when the blow tube assembly is in its sand-blowing position and closed when the blow tube assembly is in its catalyst-introducing position.

65. A sand-forming apparatus as set forth in claim 61, wherein the sand-blowing-fluid line is connected to a source which supplies the fluid at a sand-blowing pressure.

66. A sand-forming apparatus as set forth in claim 65, wherein the sand-passage-sealing fluid is provided from the same source as the sand-blowing-fluid line.

67. A sand-forming apparatus as set forth in claim 66, wherein the sand-passage-sealing pressure is less than the sand-blowing pressure.

68. A sand-forming apparatus as set forth in claim 66, further comprising a sand-passage-sealing line and a pressure-reducing device which reduces the supply pressure of the fluid upstream of the sand passage.

69. A sand-forming apparatus as set forth in claim 68, further comprising a gate device which prevents fluid flow from the pressure-reducing device when the apparatus is in its sand-blowing state and permits flow from the pressure-reducing device when the apparatus is in its catalyst-introducing state.

70. A sand-forming apparatus as set forth in claim 69, wherein the sand-blowing-fluid closes the gate device when the apparatus is in its sand-blowing state.

71. A method of retrofitting a sand-forming apparatus comprising a box comprising a cope and a drag which together define a cavity having a shape corresponding to the desired sand-shape; said retrofitting method comprising the steps of:

providing an inner tube and an outer tube which are telescopically movable relative to each other between a sand-blowing position whereat they form a sand passageway which communicates with the cavity and a catalyst-introducing position whereat the sand passageway is sealed from the cavity;

mounting the inner tube to a blowplate;

mounting the outer tube to the ceiling of the cope; and wherein relative movement between the cope and the blowplate converts the apparatus between:

a sand-blowing state whereat a sand head can communicate with the cavity via the sand passageway; and a catalyst-introducing state whereat the sand passageway is sealed from the cavity, wherein a bonnet is mounted to the blowplate, and the bonnet opens to a vent window which communicates with the cavity via cope passages when the apparatus is in the sand-blowing state, and the bonnet defines a sealed catalyst chamber which communicates with the cavity via the cope passages when the apparatus is in a catalyst-introducing state, and wherein the apparatus further comprises a sealed catalyst chamber on a drag side of the box, wherein the sealed catalyst chamber on the drag side of the box communicates with a source of catalyst.

* * * * *

UNITED STATES PATENT AND TRADEMARK OFFICE

CERTIFICATE OF CORRECTION

PATENT NO. : 8,353,328 B2
APPLICATION NO. : 12/602668
DATED : January 15, 2013
INVENTOR(S) : Gerald B. Senk, Jr. et al.

It is certified that error appears in the above-identified patent and that said Letters Patent is hereby corrected as shown below:

Title Page, Item (57) Abstract should read – "A sand-forming apparatus (10) comprising a box (20), a blow tube assembly (50) and a bonnet (90). The box (20) has a cope (30) and a drag (40) which together define a cavity (21) having a shape corresponding to a desired sand-shape. The blow tube assembly (50) comprises a blowplate (53), and at least one tube (50). The bonnet (90) may be fixed to and movable with the blowplate (53). Relative movement between the cope (30), the blow plate (53) and/or the bonnet (90) converts the apparatus (10) between a sand-blowing state and a catalyst-introducing state."

Signed and Sealed this
Twelfth Day of November, 2013

Teresa Stanek Rea

Teresa Stanek Rea
*Deputy Director of the United States Patent and Trademark Office*